United States Patent [19]

Pierson et al.

[11] 4,155,235

[45] May 22, 1979

[54] PRODUCTION OF HEAVY PURE ALUMINUM COATINGS ON SMALL DIAMETER TUBING

[75] Inventors: Marvin B. Pierson, Franklin; Charles Flinchum, Hamilton, both of Ohio

[73] Assignee: Armco Steel Corporation, Middletown, Ohio

[21] Appl. No.: 815,319

[22] Filed: Jul. 13, 1977

[51] Int. Cl.[2] ..... B21C 37/06; B05D 3/00; B05D 3/12; C23C 1/02

[52] U.S. Cl. ..... 72/47; 427/320; 427/329; 427/431; 427/434 D; 427/436; 427/398 R

[58] Field of Search ..... 427/320, 329, 431, 434 D, 427/436, 398 R; 72/47

[56] References Cited

U.S. PATENT DOCUMENTS

| | | | |
|---|---|---|---|
| 2,570,906 | 10/1951 | Alferieff | 427/320 |
| 2,926,103 | 2/1960 | Brick | 427/320 |
| 2,935,420 | 5/1960 | Linden | 427/320 |
| 3,010,844 | 11/1961 | Klein et al. | 427/320 |
| 3,018,194 | 1/1962 | Norman et al. | 427/320 |
| 3,457,097 | 7/1969 | Yonezaki et al. | 427/320 |
| 3,468,695 | 9/1969 | Federman | 427/320 |
| 3,526,529 | 9/1970 | Pierson et al. | 427/320 |
| 4,053,663 | 10/1977 | Caldwell et al. | 427/320 |

*Primary Examiner*—Michael F. Esposito
*Assistant Examiner*—Richard Bueker
*Attorney, Agent, or Firm*—Melville, Strasser, Foster & Hoffman

[57] ABSTRACT

A method, and an apparatus for practicing the method, for producing heavy pure aluminum coatings on small diameter steel tubing are disclosed. The coating has an average thickness of 0.004 inch to 0.008 inch (100–200 μm), to provide outstanding resistance to corrosion, and to maintain integrity in the face of abrasive action, and with coating ductility and adherence sufficient to permit double flaring. The method and apparatus are highly useful in the manufacture of Bundyweld tubing for automotive brake lines, and single wall tubing for refrigeration or air conditioner heat exchangers. Various surface preparations are disclosed; and after surface preparation the tube is uniformly heated to a carefully regulated peak temperature in a non-oxidizing high intensity direct fired furnace, followed by passing the tube vertically upward through a shallow pool of molten aluminum, whereby to cast on a thick coating, followed by "free exit" finishing, air quenching, and, if desired, redrawing.

10 Claims, 1 Drawing Figure

PRODUCTION OF HEAVY PURE ALUMINUM COATINGS ON SMALL DIAMETER TUBING

BRIEF SUMMARY OF THE INVENTION

BACKGROUND OF THE INVENTION

It is highly desirable for various applications to provide steel tubing with a heavy coating of pure aluminum. By way of example, double-wall tubing, such as the well known Bundyweld tubing, shown in Gondek, U.S. Pat. No. 3,957,086, is used in automotive brake lines where it is subject to significant corrosive action by road deicing salts, and to various mechanical hazards and abrasive action. Terne coating (lead-tin alloy) and electrolytic zinc coating historically used for protecting double-wall brake lines, no longer provide sufficient protection because of the greatly increased use of road deicing salts. Brake line tubing is double flared during fabrication, so that any protective coating used must not only be resistant to corrosion and abrasion, but it must also possess outstanding ductility and adhesion. In addition, the condenser coils in air conditioners are generally fabricated from copper tubing to withstand severe corrosive action and for ease of fabrication.

An inexpensive uniform pure aluminum coating with a minimum average thickness of about 0.004 inch (100 μm) meets the stringent current requirements for Bundyweld brake line tubing. Such a coating also renders single-wall steel tubing an attractive alternative to expensive copper tubing for air conditioner condenser coils.

THE INVENTION

According to the present invention, the tubing may be first cleaned in any number of ways, depending upon its condition coming to the coating line. It is then passed through a non-oxidizing high intensity direct fired furnace, where it is uniformly heated to a carefully regulated peak temperature below the melting point of the aluminum with which the tubing is to be coated. This peak temperature level is the primary means of coating thickness control as the tubing is then passed vertically upward through a shallow pool of molten aluminum, whereby to cast on a coating. No finishing means is used except an optional hydrogen bath cover at the point of tube emergence. After coating, an air quench aids in coating solidification and in limiting alloy formation. The tubing may thereafter be redrawn.

BRIEF DESCRIPTION OF THE DRAWING

The single FIGURE is a diagrammatic view of an apparatus for carrying out the method of this invention.

DETAILED DESCRIPTION

Figure 1:
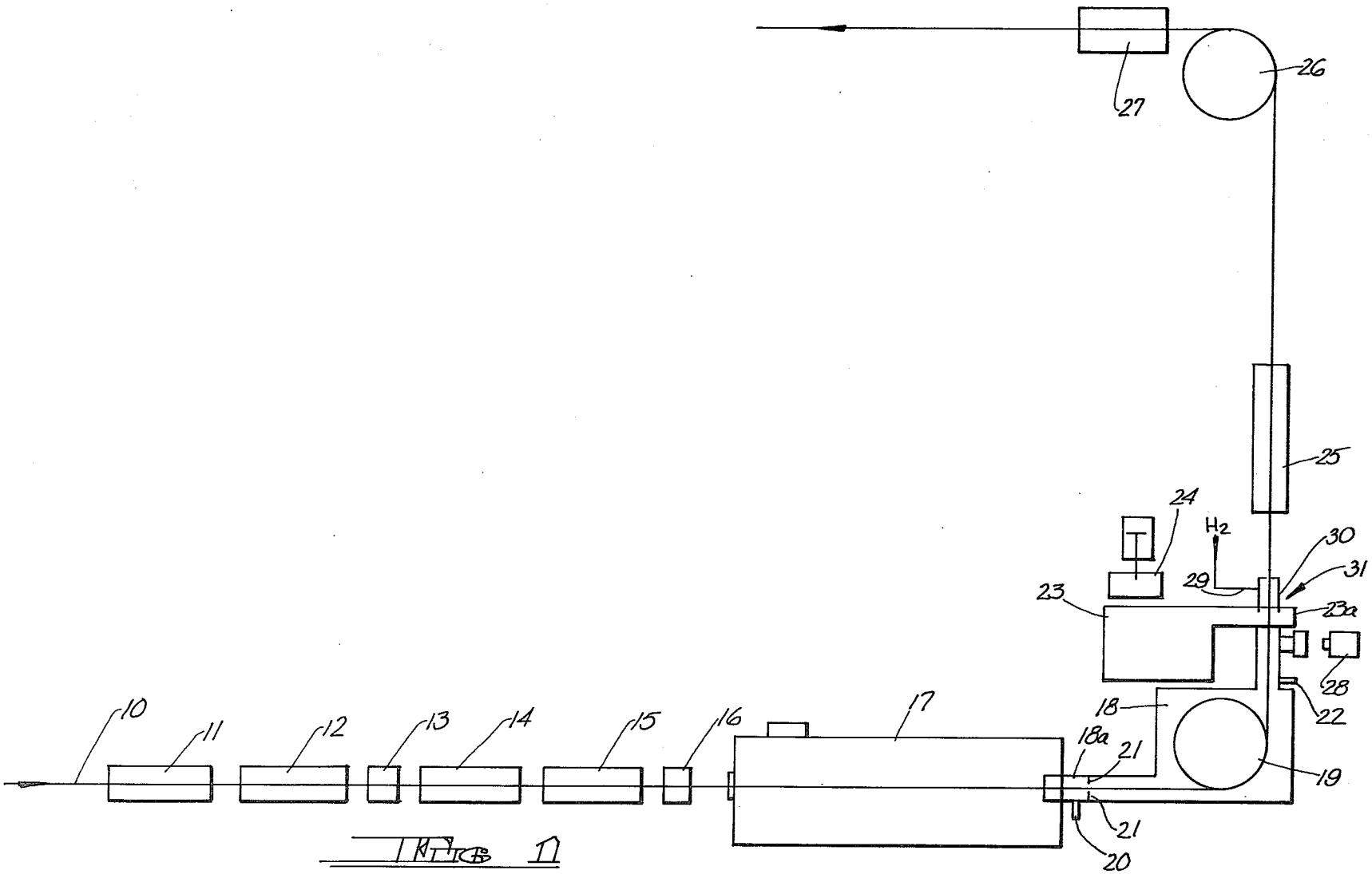

The FIGURE of the drawing diagrammatically shows a coating line wherein an incoming tube (whether it be a double-wall tube such as the so-called Bundyweld tube, or a single-wall tube) is indicated at 10.

Whatever the condition of the tubing as it comes to the coating line, the cleaning must be sufficient so that instant wetting with aluminum will take place and such that a continuous alloy layer will form between the iron and aluminum. The degree of cleanliness is actually more critical than it is for ordinary hot coating processes because of the low base temperature and short immersion time which decrease the effective reactivity of the aluminum.

The wet cleaning steps may be altered and perhaps even eliminated, depending upon the degree of surface contaminants such as oil, smut and oxide. For example, if the tubing to be coated is double-wall tubing, generally it is only necessary to use the direct fired furnace for surface preparation. In such cases, it is necessary to minimize or eliminate the usual plated copper on the outside surface of such tubing from the tube manufacturing process to avoid galling in the close tolerance openings of the coating equipment.

The tubing first enters the cleaning apparatus which is indicated at 11. This apparatus may involve the use of a solvent or an alkaline cleaning solution and scrubbers for oil removal from single-wall tubing.

The tubing 10 then may pass into a heating device at 12. The heating apparatus 12 may include an induction coil, insulated from the tube by a quartz insert, which will heat the tubing to form a dark straw to blue oxide coating. Any vaporized residual oils may be purged from the heater with compressed air to prevent condensation and redeposition on the hot tube surface as a carbonaceous residue which would not be removed in subsequent steps and which would prevent wetting of the tube surface by aluminum.

The tubing then passes to the quenching apparatus 13 so that overheating of the acid in the acid pickle device 14 is avoided. The acid pickle unit 14 may make use of a dilute hydrochloric acid solution (for example 10%) which may be recirculated and which produces a bright surface required for coating.

After the pickling step the tubing passes into the unit 15 which is a hot water rinsing apparatus and may include ultrasonic agitation and this device removes pickling residues. Upon emerging from the hot water rinse, the tubing passes to an air blow-off apparatus indicated at 16 and thence into the high intensity direct fired furnace. It should be understood that cleaning or surface preparation shown in the FIGURE is exemplary only, and as indicated above may be varied depending upon the condition of the tubing as it comes to the coating line.

The high intensity furnace is fired by premixed natural gas (or propane) and air to a furnace temperature of about 2300° F. (1260° C.) with a fuel-air ratio which is carefully controlled to produce about 5% excess combustibles. The direct fired furnace is indicated at 17 and from the furnace the tubing passes into the turn-up chamber. The turn-up chamber is indicated at 18 and it is separated from the entry portion **18*a* by baffles 21. A hydrogen inlet 20 prevents high-dew point combustion product gases from causing oxidation of the tube. The remainder of the turn-up chamber 18 contains a nitrogen atmosphere which is injected at 22. The nitrogen which is injected into the turn-up chamber 18 maintains an inert atmosphere therein up to the coating apparatus and exhausts through portion 18*a* into the direct fired furnace 17. It is important that hydrogen gas be kept away from the coating head since the reaction products formed with the aluminum at the coating head entry can attach onto the tube surface as it enters the coating pot causing "hash mark" uncoated spots. The temperature in the turn-up chamber is adjusted to the same temperature as the incoming tube in order to maintain even circumferential tube temperature as the tube contacts the turn-up sheave 19. To summarize the atmospheres in the portions 18*a* and 18, it may be stated that hydrogen is required adjacent to the furnace 17 in the portion 18***a* in order to overcome the oxidizing effects of wet combustion products which might back-diffuse into this relatively cool area. On the other hand, nitrogen is necessary in the chamber 18 to avoid hydrogen at the point of tube entry to the coating metal in order to insure optimum wetting. The tubing passes through the direct fired furnace without contacting the furnace walls, thereby avoiding the production of hot spots and the resulting non-uniform coating.

The peak temperature, which is very important, is regulated by speed. It will be understood that where the furnace has a fixed length and a fixed operating temperature, the temperature to which the tube is heated is controlled by regulating the speed, and this is the most effective control of coating weight. If the temperature is increased, the coating thickness is decreased; and conversely, a decrease in the temperature results in a heavier coating.

It is desirable to minimize coating weight in casting on aluminum onto tubing. However, a coating thickness of 0.004 to 0.005 inch (100 to 125 μm) is the least weight possible without reverting to hot practice which produces coatings usually less than 0.0005 inch (12.5 μm) and such coatings are too light for corrosion resistance requirements. It is desirable to operate the apparatus under stable conditions and to control the coating thickness at 0.005 to 0.006 inch (125 to 150 μm). If colder operation is carried on, heavier coatings will be produced but such coatings are not required for corrosion resistance and would be wasteful of the coating metal. The temperatures mentioned herein were measured with an infrared thermometer with emissivity set at 0.33.

By way of example, with single-wall 3/16 inch diameter tubing (4.76 mm) the tube temperature should be between about 900° and about 1020° F. (500° to 567° C.) and preferably between about 980° and 990° F. (544° and 550° C.). In larger diameter single-wall tubing, as for example 5/16 inch (7.94 mm) the maximum temperature should be about 980° F. (544° C.) and the minimum about 900° F. (500° C.) and the preferred range is from about 925° to 940° F. (515° to 522° C.). With 3/16 inch (4.76 mm) double-wall tubing, the maximum tube temperature should be about 810° F. (450° C.) and the minimum about 715° F. (395° C.) with the preferred range between about 780° and 790° F. (433° and 440° C.). It should be noted that the atmosphere in the high intensity direct fired furnace should be carefully controlled so as to be non-oxidizing under dynamic operating conditions.

Upon issuing from the direct fired furnace 17 and passing through the chamber 18*a* into the turn-up chamber 18, the tubing passes around a turn-up sheave 19. The chamber 18 as indicated above is hydrogen free and subject to a nitrogen atmosphere which is introduced at 22. As has been indicated above, the chamber 18 is heated by external means (not shown) to a temperature approximately that of the peak tube temperature to avoid disturbing the tube temperature uniformity as it passes around the sheave.

The turn-up sheave serves to turn the tubing from a horizontal path to a vertical path and the tubing exits from the chamber 18 and passes through the aluminum bath in a vertical direction. A nitrogen inlet is indicated at 22 so that while the tubing is first under a hydrogen-nitrogen atmosphere in the chamber 18*a*, it is finally under a nitrogen atmosphere alone with a purposeful exclusion of hydrogen at the point where it enters the coating bath.

The coating pot is indicated at 23. The pot should be ceramic lined in order to avoid iron contamination of the bath. The pot 23 has the extension 23*a* which holds the molten aluminum pool through which the tubing passes and from which the aluminum is cast onto the tubing. A displacement plug 24 has for its purpose to flood the coating head and drop the metal level below the coating head when it is necessary to stop the line. This is a more or less straight-forward and simple device which will not be described further.

The depth of the aluminum bath through which the tubing passes is somewhat critical. As a minimum, it must be sufficient to provide a static pressure head which is greater than the atmospheric pressure in the chamber below. If chamber atmosphere is permitted to bubble through the aluminum around the tube, the result would be uncoated spots on the tubing. A positive chamber pressure is desired in order to minimize system leak effects.

On the maximum side, the greater the bath depth the greater the hazard of aluminum dropping through the entry die. Since the present invention involves a cast-on process, the time of immersion is an important factor in influencing coating weight, which is directly influenced by either bath depth or tube speed. In a production line, bath depth would be fixed somewhere between ¼ inch (6.35 mm) and ¾ inch (19 mm) and held essentially constant. Small high intensity oxy-gas burners at 31 are useful in maintaining the coating pool molten in the face of the quenching action of the cold tube passing through the bath. It will be noted that no exit die is provided except for the protection of hydrogen at the meniscus which is introduced at 29 to a ceramic cup 30 which may or may not contact the molten aluminum. This serves to protect the meniscus from the high intensity flame of the gas-oxygen burners. Thus the tube exits free vertically out of the molten aluminum. The enclosure 30 surrounds the tubing and may or may not be sealed in the molten aluminum pool, and floods the bath with hydrogen at the point of tube emergence.

The tubing exits with a film of molten aluminum over an apparent solidified aluminum layer. This molten film is quickly solidified with the aid of the vertical air quench diagrammatically indicated at 25. This is preferably an air quench which will arrest aluminum-iron alloy growth and complete the solidification before the tubing passes around the sheave 26 whence it may be subjected to an additional quench with water at 27 and then pass onto suitable takeup means.

The temperature of the coating metal pool is not apparently critical with respect to a maximum but it must be maintained above a minimum level for good coating finish. The minimum desirable temperature of the pool is about 1300° F. (about 720° C.) with a temperature in the range between about 1400° and 1500° F. (about 775° and 835° C.) preferred. The pool temperature apparently does not strongly affect the cast-on coating applied because the heat of fusion of aluminum is 93 cal/g as against a specific heat of only 0.25 cal/g/° C. The exit meniscus where the tubing emerges from the bath may be protected with a hydrogen atmosphere prior to the tubing entering the air quench apparatus as indicated above.

The tubing coated by the method and with the apparatus as described above, is characterized by a concentric coating which is normally in the range of 0.004 to 0.008 inch (100–200 μm) thick. It is preferred to minimize the coating thickness at 0.004 to 0.005 inch (100 to 125 μm) without reverting to the hot coating practice producing coatings less than 0.001 inch (25 μm).

The coating on the tubing has a continuous thin alloy layer of 0.0002 inch (5 μm) or less with pure aluminum and this structure produces excellent adherence which can withstand a severe double flaring operation without any sign of separation or failure. The as-coated finish is excellent by hot dip coating standards but it can be improved further with a light redraw. Iron contamination of the coating bath is considerably less than saturation and this results in excellent coating ductility and an absence of iron-aluminum dross. The use of a ceramic vessel avoids iron contamination of the bath from this source and because of the favorable balance between the iron solution rate from the entering clean tube and the rate of pure metal addition (metal withdrawal) iron build-up to levels which interfere with ductility and corrosion resistance are avoided.

As indicated above, it should be noted that there is a unique problem associated with double-wall tubing. Normal copper coated double-wall tubing cannot be passed hot through an orifice such as is involved in the present apparatus because of the tendency to gall and bind. This problem can be avoided by using double-wall tubing with no copper or with only a light copper flash on the outer surface.

As was indicated above, the depth of the molten aluminum puddle through which the tubing passes vertically upward is between ¼ inch (6.35 mm) and ¾ inch (19 mm) and is preferably about ⅜ inch (9.5 mm). The temperature of the molten aluminum in the puddle should be a minimum of 1300° F. (720° C). With 3/16 inch (4.75 mm) single-wall or double-wall tubing a preferred range of temperature is from about 1325° F. (735° C.) to about 1400° F. (780° C.) and with 5/16 inch tubing (7.94 mm) it is preferably from about 1400° F. (780° C.) to about 1500° F. (835° C.).

Assuming a standard tubing speed of 60 fpm (18 mpm) the immersion time with the minimum quarter inch (6.35 mm) puddle depth is 0.02 seconds and with the maximum puddle depth of ¾ inch (19 mm) the immersion time is 0.06 seconds. A puddle depth of ⅜ inch (9.5 mm) is preferred at a speed of 60 fpm (18 mpm). It is indicated that a deeper puddle may be satisfactory at higher speed. However, at 60 fpm (18 mpm) a better finish consistency is achieved by minimizing the puddle depth. As indicated heretofore, within the temperature ranges for the tubing as it passes through the molten aluminum puddle, the higher the tube temperature, the thinner the coating thickness. The temperature of the tubing as it is about to enter the molten puddle may be determined by means of an infrared thermometer indicated at 28.

The mechanical properties of tubing coated according to the present invention as compared with double-wall electrogalvanized and copper-nickel alloy brake line tubing are shown in Table I below.

TABLE I

| | Yield psi | Strength (MPa) | Tensile psi | Strength (MPa) | % E in 2" | Hardness 30T-HRB |
|---|---|---|---|---|---|---|
| Double-wall electro-galv. | 40,000 | (276) | 55,500 | (383) | 21 | — |
| -Al coated | 49,000 | (337) | 58,500 | (403) | 19 | 51–52 |
| -Al coated & drawn 5% | 72,750 | (502) | 75,000 | (517) | 9 | 65–72 |
| Copper Nickel | 26,500 | (183) | 51,000 | (352) | 26.5 | — |

Adherence excellent as judged by double flare.

For corrosion resistance in various environments according to European automakers specifications, a comparison between 0.001 inch (25 μm) electrogalvanized passivated double-wall tubing and aluminum coated double-wall tubing is shown in Table II for exposure to acid salt spray.

TABLE II

| Acid Salt Spray (ASTM B287) - 3 in. (76 mm) I.D. coils | Hours to Red Rusting |
|---|---|
| Minimum Requirement | 1000 |
| Electrogalvanized | 127 |
| Al-Coated | (No Red Rust After 1000 Hrs.) |
| Al-Coated-Drawn | (No Red Rust After 1000 Hrs.) |

Table III shows corrosion resistance according to Kesternich test.

TABLE III

| Kesternich Test - ⅝" (16 mm) I.D. Coils | Cycles to Red Rusting |
|---|---|
| Minimum Requirement | 20 |
| Electrogalvanized | 14 |
| Al-Coated | (No Red Rust After 20 Cycles) |
| Al-Coated-Drawn | (No Red Rust After 20 Cycles) |

Table IV shows the results when these materials are subjected to a neutral salt spray.

TABLE IV

Neutral Salt Spray (ASTM B117) - Straight lengths in vertical and horizontal exposure.

| | Hours to 1st Red Rust | | Bursting Strength-psi (MPa) After Salt Spray Exposures | | | | |
|---|---|---|---|---|---|---|---|
| | Min. Req. | Results | As Rec'd. | 1100 Hrs. | 1500 Hrs. | 2200 Hrs. | 4300 Hrs. |
| Electro-galv. | Hor. 240 | 576 | 9400 (65) | 8800 (61) | 6900 (48) | 8400 (58) | Perforated |
| & Passivated | Vert. | 2200 | | | | 9200 (63) | 7300 (50) |
| Al-Coated | Hor. 240 | (4300 Hrs-None) | 10,000 (69) | | | | 10,900 (75) |
| | Vert. | | | | | | 10,500 (72) |
| Al-Coated & | Hor. | (4300 Hrs-None) | 21,500 (148) | | | | 19,200 (132) |
| Drawn 5% | Vert. | | | | | | 19,000 (131) |
| Copper-Nickel | Hor. | | 7600 (52) | | 7100 (49) | | |

Bursting strength of Al-coated double-wall tubes was not reduced by 6 months neutral salt spray exposure. Redrawn Al-coated single-wall tubing has accummulated over 1½ years in neutral salt spray without coating failure.

It will be understood that numerous modifications may be made without departing from the spirit of the invention. No limitation which is not expressly set forth in the claims is therefore intended and no such limitation should be implied.

The embodiments of the invention in which an exclusive property or privilege is claimed are defined as follows:

1. The method of producing a pure aluminum coating of a thickness of from 0.004 inch to 0.008 inch (100–200 μm) on a continuous interface alloy of about 0.0002 inch, on small diameter steel tubing while continuously moving said tubing in a path, which includes the steps of:

(a) passing said tubing through a non-oxidizing, high intensity, direct fired furnace of a fixed length, and having a fixed operating temperature, at a speed such as to uniformly heat the tubing to a peak temperature of from about 800° F. (445° C.) to about 1020° F. (567° C.), (b) passing said tubing through a turn-up chamber heated to about said peak temperature by external means, and containing a hydrogen-nitrogen atmosphere, (c) passing said tubing vertically upward out of said turn-up chamber under an exclusively nitrogen atmosphere with purposeful exclusion of hydrogen, (d) passing said tubing vertically upward through a shallow bath of molten aluminum, and (e) allowing the coated tubing to exit free from said bath and immediately air quenching it.

2. The method of claim 1, which includes the step of performing cleaning operations on said tubing to prepare it to accept a coating of pure aluminum.

3. The method of claim 1, wherein the speed of travel of the tubing is above about 60 feet per minute (18 mpm).

4. The method of claim 1 wherein the temperature of the molten aluminum is at least 1300° F. (720° C.).

5. The method of claim 1 wherein the temperature of the molten aluminum is between about 1400° F. and about 1500° F. (775°–835° C.).

6. The method of claim 1 wherein the depth of the bath of molten aluminum is between about ¼ inch and about ¾ inch (6.35–19 mm).

7. The method of claim 1 which includes the step of redrawing the finished tubing.

8. The method of claim 1 wherein the tubing is single-wall tubing.

9. The method of claim 1 wherein the tubing is double-wall tubing, having a copper plating principally on one side only, so that when formed into tubing, the outside of said tubing will have no more than a flash coating of copper.

10. The method of claim 1 wherein the tubing exits from said bath with a hydrogen cover.

* * * * *